US008774367B2

(12) United States Patent
Behling et al.

(10) Patent No.: US 8,774,367 B2
(45) Date of Patent: Jul. 8, 2014

(54) BEARING WITHIN AN X-RAY TUBE

(75) Inventors: Rolf Karl Otto Behling, Norderstedt (DE); Christoph Bathe, Hamburg (DE); Michael Luebcke, Hamburg (DE); Van-Minh Duong, Hamburg (DE); Krishna Swamy, Hamburg (DE)

(73) Assignee: Koninklijke Philips N.V., Eindhoven (NL)

( * ) Notice: Subject to any disclaimer, the term of this patent is extended or adjusted under 35 U.S.C. 154(b) by 581 days.

(21) Appl. No.: 13/125,327

(22) PCT Filed: Oct. 19, 2009

(86) PCT No.: PCT/IB2009/054594

§ 371 (c)(1), (2), (4) Date: Jul. 27, 2011

(87) PCT Pub. No.: WO2010/046837

PCT Pub. Date: Apr. 29, 2010

(65) Prior Publication Data

US 2011/0280376 A1 Nov. 17, 2011

(30) Foreign Application Priority Data

Oct. 22, 2008 (EP) ..... 08167235

(51) Int. Cl.
*H01J 35/00* (2006.01)

(52) U.S. Cl.
USPC ..... 378/132

(58) Field of Classification Search
USPC ..... 378/119, 121, 125, 132, 143, 144
See application file for complete search history.

(56) References Cited

U.S. PATENT DOCUMENTS

| | | | | |
|---|---|---|---|---|
| 5,204,890 | A | 4/1993 | Anno et al. | |
| 5,380,112 | A | 1/1995 | Schicktanz et al. | |
| 5,384,818 | A | 1/1995 | Ono et al. | |
| 6,269,146 | B1 * | 7/2001 | Ohnishi et al. | 378/130 |

FOREIGN PATENT DOCUMENTS

| | | | |
|---|---|---|---|
| EP | 0019339 | A1 | 11/1980 |
| EP | 1132941 | A2 | 9/2001 |
| EP | 1168414 | A2 | 1/2002 |
| GB | 1577738 | A | 3/1976 |
| JP | 60060736 | | 9/1986 |
| JP | 2007100834 | A2 | 4/2007 |

* cited by examiner

*Primary Examiner* — Courtney Thomas

(57) ABSTRACT

An X-ray tube for generating X-radiation includes a rotary structure having a rotating anode, a stationary structure for rotatably supporting the rotary structure, and a hydrodynamic bearing which is arranged between the rotary structure and the stationary structure. The bearing includes a gap between the rotary structure and the stationary structure, a stabilizer configured to stabilize dimensions of the gap with respect to distortions because of thermo-mechanical causes.

20 Claims, 9 Drawing Sheets

BEARING WITHIN AN X-RAY TUBE

FIELD OF THE INVENTION

The present invention relates to an X-ray tube for generating X-radiation and a method for manufacturing an X-ray tube, and an X-ray system for diagnostic use comprising an X-ray tube and in particular to a method for manufacturing an X-ray system, which comprises an X-ray tube.

BACKGROUND OF THE INVENTION

A rotating anode X-ray tube generates X-radiation in a diagnostic system, wherein the anode of the X-ray tube heats up upon operation and cools during exposure and afterwards.

The thermal heat flow and thermal cycling causes thermo mechanical distortion of the tube components. Therefore, the tube components have to be designed such that reliable operation is guaranteed under all specified conditions.

Many modern high performance X-ray tubes use hydrodynamic bearings to support the rotating anode and to dissipate the heat from the anode by direct conduction cooling towards an external cooling fluid. The loading capacity of these hydrodynamic bearings is a strong function of the gap size between the active surfaces of the rotating and stationary bearing members. The gap size is typically in the range of only 5 to 20 um, while the range of bearing diameters is typically 2 to 10 cm, its length 5 cm to 15 cm. So the gap is of relatively small size. Given a certain speed of rotation, large gaps as well as low viscosity of the bearing fluid (hot liquid metal) both cut down the loading capacity (bearing stiffness).

SUMMARY OF THE INVENTION

Therefore, it would be desirable to provide an improved device and method for stabilising the gap of the bearing. These needs may be met by the subject matter according to one of the independent claims. Advantageous embodiments of the present invention are described in the dependent claims.

According to the invention the size of the bearing gap is stabilized against thermo mechanical distortion using controlled matching expansion of the bearing members. This can be achieved by using at least some parts of the members materials of different thermal expansion coefficients $c_{th}$. (E.g. the material of the bearing member which is at lower temperature during operation is selected to have a higher $c_{th}$ compared to the material of the member at higher temperature). Another solution is to use mechanical piston-like force generation e.g. by hydraulic means. The advantages are e.g. a reduction of friction losses in cold state and a prevention of rotation instability in hot state.

According to a first aspect of the invention an X-ray tube for generating X-radiation is proposed. The X-ray tube for generating X-radiation comprises a rotary structure, which comprises a rotating anode, a stationary structure for rotatably supporting the rotary structure, a bearing, which is arranged between the rotary structure and the stationary structure, wherein the bearing comprises a gap between the rotary structure and the stationary structure, means for stabilising the dimensions of the gap with respect to distortions because of thermo-mechanical causes.

The X-ray tube and the anode will be heated during operation by electron beam, which impinges on the target to generate X-ray. Therefore, a circulating cooling fluid system is arranged to compensate and to stabilise the temperature of the tube. There are regions of different temperature within the tube. Different temperatures lead to different expansion of the gap of bearing between the stationary part of the tube and the rotary part of the tube. In case the key gap dimensions vary locally (especially in case of different sizes of the cross-section) problems may arise during operation of the X-ray tube. Therefore, the tube according to the invention has means for compensating the above mentioned effect, which results in approximately constant key dimensions of the gap of bearing.

According to a second aspect of the invention it is provided a method for manufacturing the tube, wherein means for stabilising the dimensions of the gap are arranged.

According to a third aspect of the invention it is proposed an X-ray system for diagnostic use comprising the tube, wherein the X-ray system is adapted to stabilise the dimensions of the gap.

According to a fourth aspect of the invention it is proposed a method for manufacturing the X-ray system, wherein means for stabilising the dimensions of the gap are arranged in such a way that the X-ray system is adapted to stabilise the dimensions of the gap.

According to the present invention it is provided an X-ray tube, wherein the tube comprises a wall as a mechanical limitation for the gap, wherein the means for stabilising comprise an inlay, which is inserted in the wall, wherein the inlay has a different thermal expansion coefficient with respect to at least a part of the wall.

There are regions of different temperature because of the arrangement of a heat source (the anode) and a heat sink (the circulating cooling fluid). Therefore, the expansion of the material can also be different. This could result in a deformation of the gap. In order to avoid this effect it is proposed to arrange material, which expands little, at sites, which are hot and to arrange material, which expands in a higher degree, at sites, which are relatively cold. This can be done by inserting inlays into the tube.

According to an exemplary embodiment it is provided a tube, wherein the inlay is arranged adjacent to the gap. This is advantageously because in this case the effect of the inlays on the gap can be enhanced.

According to another exemplary embodiment it is provided a tube, wherein the inlay has a large thermal expansion coefficient, wherein the inlay is arranged in a relatively cold surrounding.

According to an exemplary embodiment it is provided a tube, wherein the inlay has a small thermal expansion coefficient, wherein the inlay is arranged in a relatively hot surrounding.

According to another exemplary embodiment it is provided a tube, wherein the inlay comprises a sandwich structure of different materials, wherein materials with a close thermal expansion coefficient compared to the thermal expansion coefficient of the wall will be arranged adjacent to the wall, wherein materials with a thermal expansion coefficient, which is substantially different compared to the thermal expansion coefficient of the wall will be arranged far away to the wall.

According to an exemplary embodiment it is provided a tube, wherein the inlay is adapted to stabilise the dimensions of the gap because of an appropriate shape. The inlay could have a shape which is adapted to the gap. In this case the shape of the inlay improves the stabilising character of the inlay in order to stabilise the dimensions of the gap.

According to a further exemplary embodiment it is provided a tube, wherein the wall is adapted to be deformed by means for deforming for stabilising the dimensions of the gap. The stationary part of the X-ray tube comprises a bearing axis.

This axis has to be hollow in order to contain the circulating cooling fluid system. In case the walls of the bearing axis are thin enough it is possible to deform these walls in order to compensate deformations of the bearing gap.

According to an exemplary embodiment it is provided a tube, wherein the means for deforming comprise a lever for applying a mechanical force on the wall.

According to another exemplary embodiment it is provided a tube, wherein the means for deforming comprise means for applying fluid pressure on the wall.

According to a further exemplary embodiment it is provided a tube, wherein the wall has a thickness of about 1 to 20 mm.

According to an exemplary embodiment it is provided a tube, wherein the means for stabilising comprise a channel for directing the flow of heat, wherein the channel is arranged in such a way that the deformation of the gap is uniform.

It should be noted that the above features may also be combined. The combination of the above features may also lead to synergetic effects, even if not explicitly described in detail.

These and other aspects of the present invention will become apparent from and elucidated with reference to the embodiments described hereinafter.

BRIEF DESCRIPTION OF THE DRAWINGS

Exemplary embodiments of the present invention will be described in the following with reference to the following drawings.

DETAILED DESCRIPTION OF EMBODIMENTS

Figure 1:
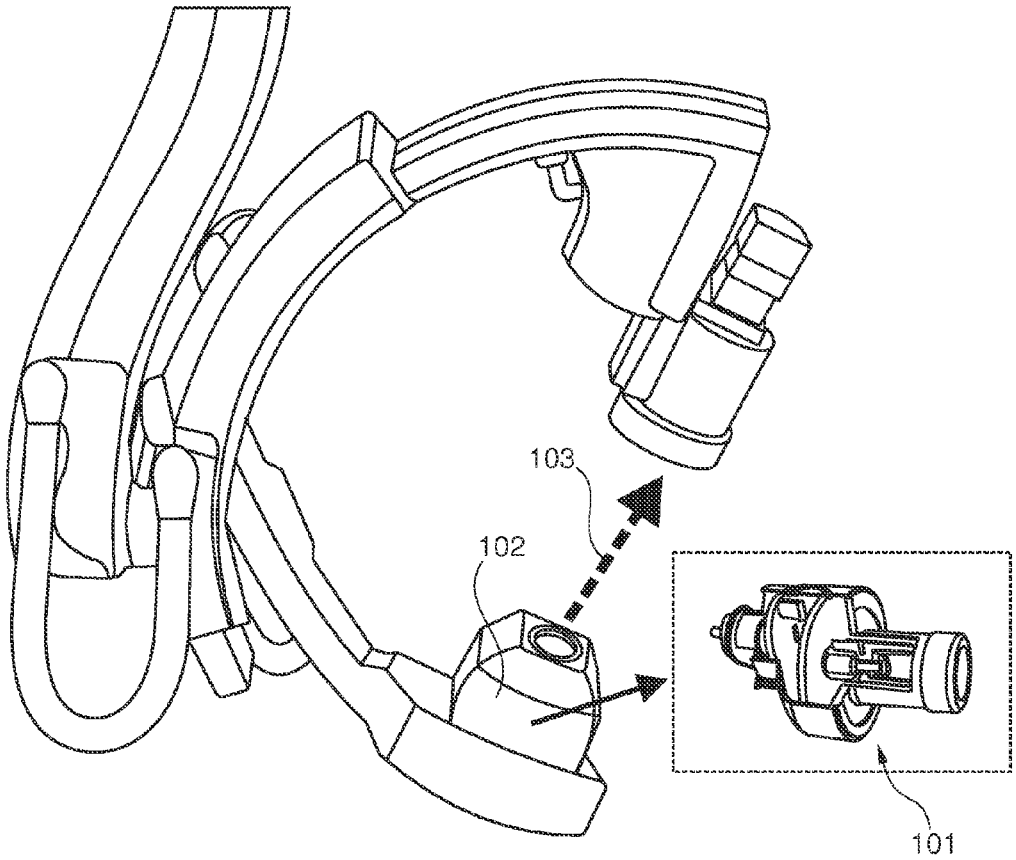
FIG. 1. shows an X-ray tube in a diagnostic X-ray system.

FIG. 1 depicts a typical X-ray tube 102, wherein the rotating anode X-ray tube 102 generates X-radiation 103 in a diagnostic X-ray system. During the X-radiation is generated by the rotating anode X-ray tube 102 the anode of the X-ray tube 102 heats up upon operation and cools down afterwards. These thermal cycling causes thermo-mechanical distortion of the X-ray tube components. Therefore, the tube components have to be designed such that reliable operation is guaranteed under all specified conditions. It is also shown a more detailed illustration of the tube 101.

Figure 2:
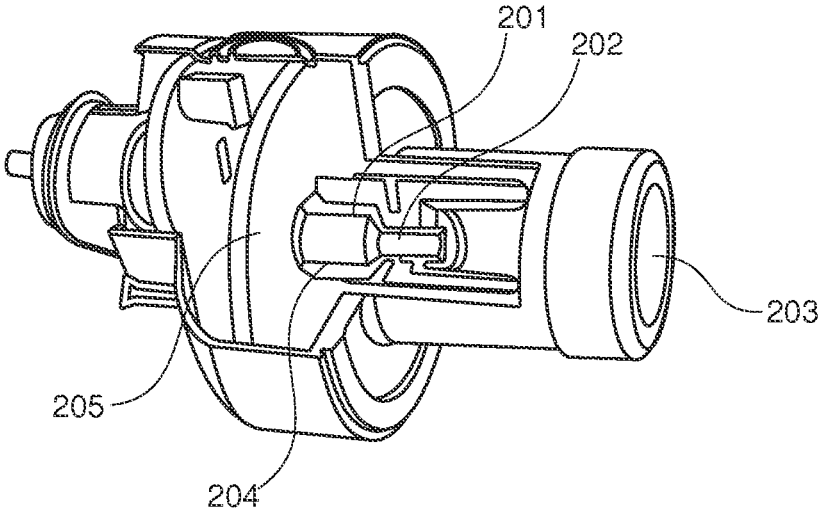
FIG. 2. shows an X-ray tube.

FIG. 2 depicts a bearing gap 201, which is filled with liquid metal, a hollow bearing axis 202, which is fixed to support the X-ray tube, a rotating bearing sleeve 204, a channel for the circulating cooling fluid 203, and a rotating anode 205.

Figure 3:
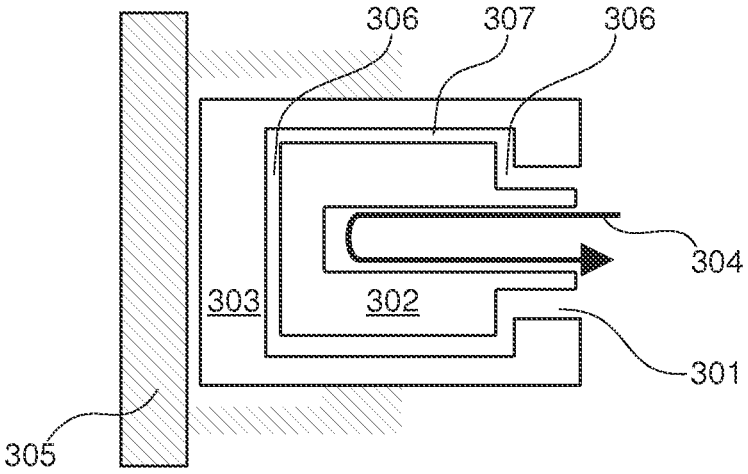
FIG. 3. shows a cross-sectional view of an X-ray tube.

FIG. 3 depicts a cross-sectional view of an X-ray tube. It is shown the rotating anode 305, the rotating bearing sleeve 303, the radial bearing 307, the axial bearing 306 and the circulating cooling fluid 304. Further, it is depicted the hollow bearing axis 302, which is fixed to the tube support.

Figure 4:
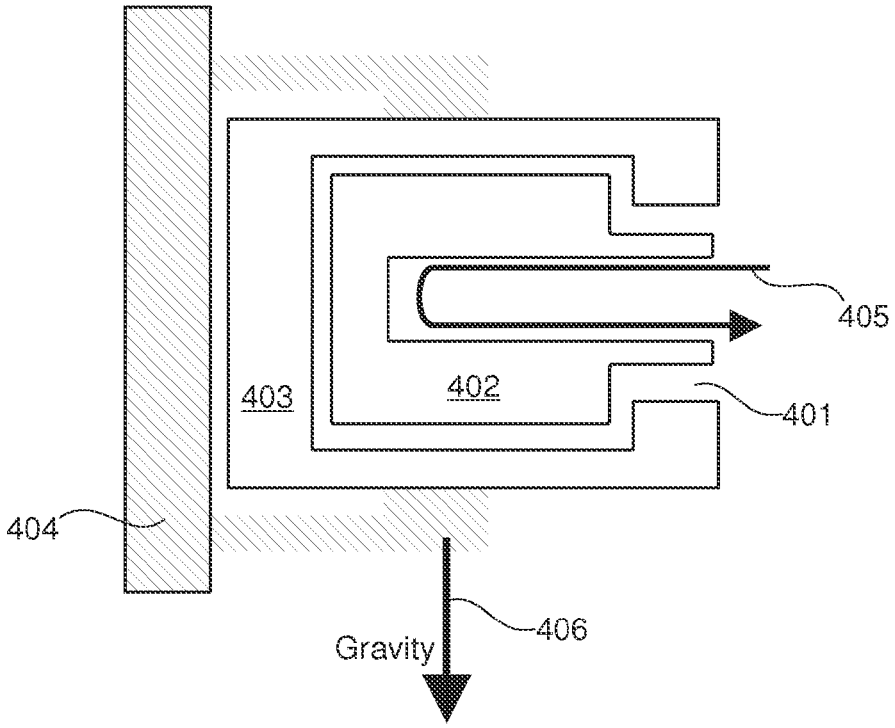
FIG. 4. shows a cross-sectional view of an X-ray tube.

FIG. 4 depicts an X-ray tube with a circulating cooling fluid 405, the bearing gap 401 and the anode 404. It is shown that there is the mechanical force of the gravity 406, which could result in deformation of the mechanical arrangement of the X-ray tube. There is also depicted a part of the rotary part 403 of the tube and a part of the stationary part 402 of the tube, wherein the stationary part of the tube 402 comprises the hollow bearing axis.

Figure 5:
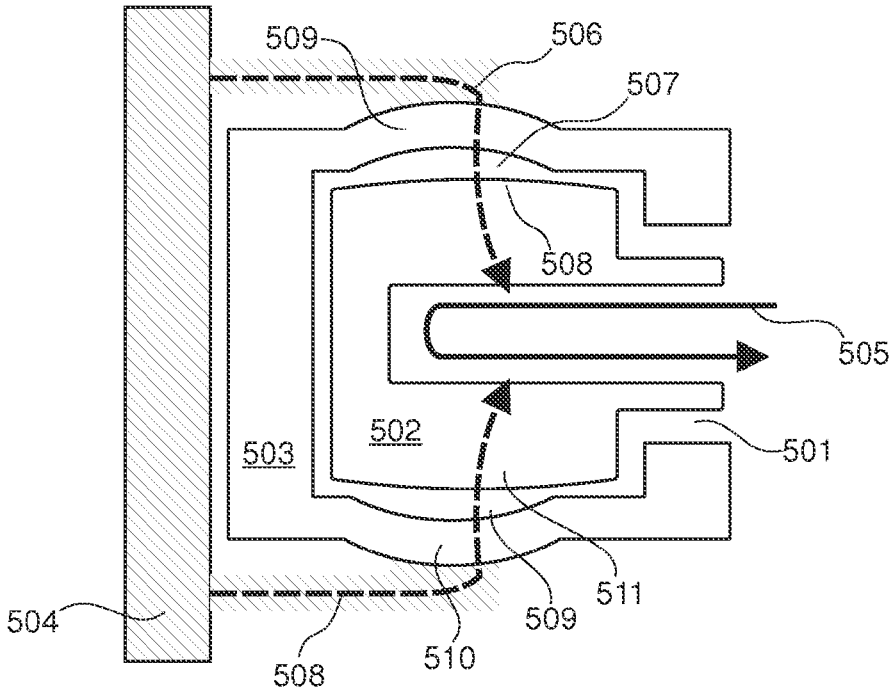
FIG. 5. shows a cross-sectional view of an X-ray tube.

FIG. 5 depicts the result of thermo-mechanical deformation because of a hot anode 504, wherein there is a heat flux 506, 508. This heat flux 506, 508 leads through the bearing gaps 507 and 509. The heat results in large expansion of the rotating bearing member because of high temperature at the sites 510, 509. Further, the heat leads to small expansion of the stationary bearing axis because of moderate temperatures at the sites 508, 511. The different dimension of expansion at the sites 507, 509 and 508, 511 leads to the consequence of increased gap sizes, which results in reduced loading capacity of the bearing at the sites 507, 509.

Summarizing the above mentioned it can be stated that the heating of the anode 504 causes thermal gradients inside the hydrodynamic bearing. Unequal expansion of its members may cause a significant distortion of the gap size and negatively affect bearing stability and loading capacity. Low viscosity of the heated bearing fluid adds negatively to this. Usually, the bearing members are of the same material. By design, they may be shaped such, that the bearing is stable under all thermal conditions. But usually, this results in an unusable loading capacity and excessive friction losses at cold state.

Figure 6:
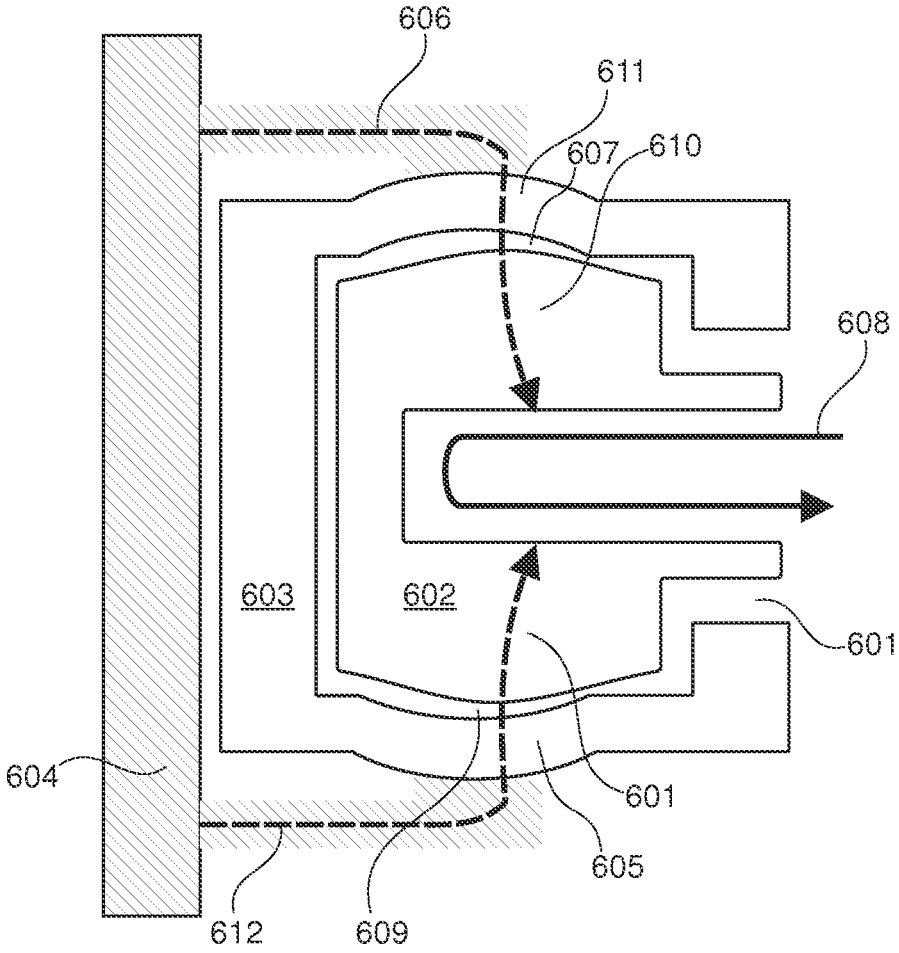
FIG. 6. shows a cross-sectional view of an X-ray tube with deformed bearing gaps, FIG. 7. shows a cross-sectional view of an X-ray tube with deformed bearing gaps, FIG. 8. shows a cross-sectional view of an X-ray tube with inlays, FIG. 9. shows a cross-sectional view of an X-ray tube with inlays, FIG. 10. shows a cross-sectional view of an X-ray tube with a piston-type mechanical expansion device, FIG. 11. shows a cross-sectional view of an X-ray tube comprising a device for hydraulic expansion of the bearing axis, FIG. 12. shows a cross-sectional view of an X-ray tube comprising channels for heat conduction.

FIG. 6 depicts stabilised gaps 601, wherein the size is kept approximately constant. This can be achieved by choosing material with a large coefficient of thermal expansion at the sites 611, 610 and by arranging material with a small coefficient of thermal expansion at the sites 605, 611. The varying of the coefficient of thermal expansion compensates the different temperatures. Therefore, the effect of stabilising the gap of the bearing 607, 609 is achieved. FIG. 6 shows the heat flux 606, 612, which starts from the hot anode 604 and runs through the rotary part 603 of the X-ray tube to the stationary part 602 of the X-ray tube. The tube will be cooled by the circulating liquid fluid 608.

Figure 7:
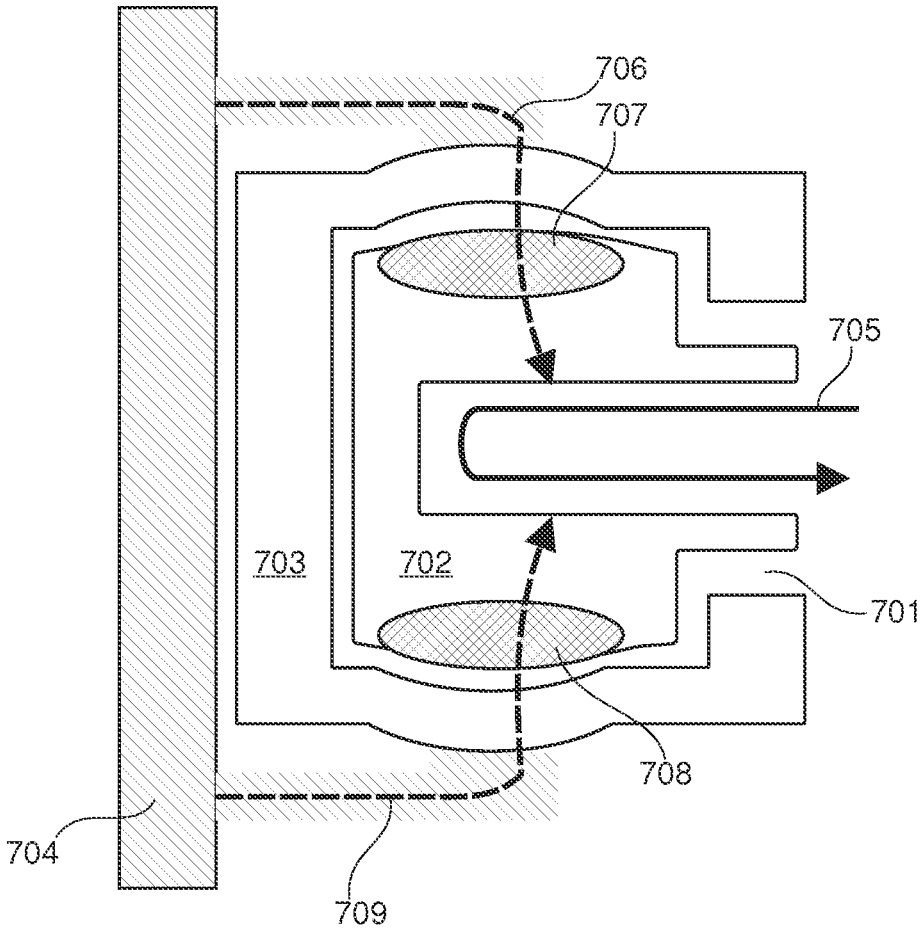

FIG. 7 depicts an embodiment of the invention, wherein the stabilising of the gaps is achieved by implementing inlays 707, 708 at the sites where the heat flux 706, 709 is passing through. The inlays 707, 708 are arranged in the neighbourhood of the border between the rotary part 703 of the X-ray tube and the stationary part 702 of the X-ray tube in such a way, that the dimensions of the gap 701 will be stabilised efficiently. The X-ray tube will be cooled by the circulating cooling fluid 705 in order to compensate the heating because of the anode 704.

The inlays 707, 708 in the bearing members 702, 703 can be used for compensation. Upon heating, they expand differently from the bulk and maintain the gap size. There could be different embodiments with the help of the inlays, e.g. using inlays with a large (compared to the bulk material) $c_{th}$ on the cold side, using inlays with a small $c_{th}$ on the hot side. Further, both embodiments can be combined.

For optimal shaping of the gap 701, the form of the inlays 707, 708 can be matched with the local heat flux pattern. With the help of this principle radial and axial bearings can be stabilized. A further option could be for chemical stability against the bearing fluid, to cover the inlays 707, 708 e.g. with the bulk material.

Figure 8:
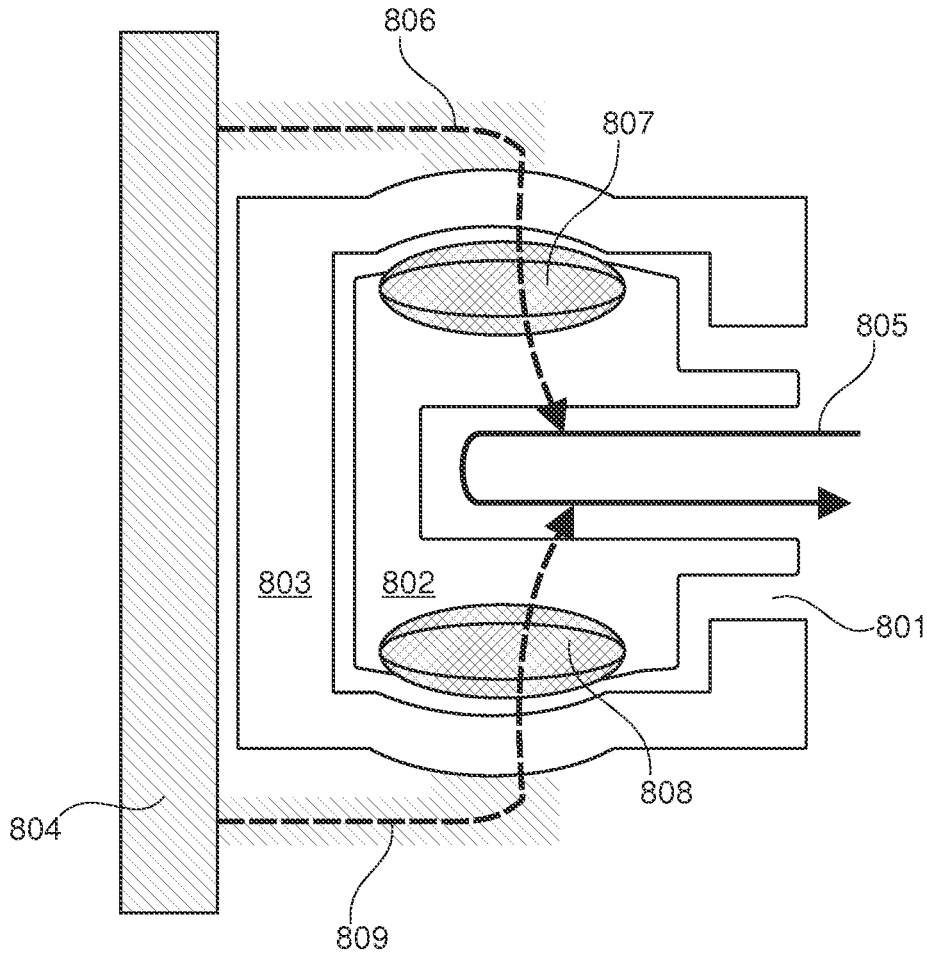

FIG. 8 depicts the X-ray tube, wherein the heat flux 806, 809, which starts from the anode 804 passes through the rotary part of the tube 803, the gap 801 and the stationary part of the tube 802. The compensation of the unequal expansion of the gap 801, because of the cold side because of the circulating cooling fluid 805 and the hot anode 804 will be achieved by arranging inlays 807, 808. One embodiment can be to use a sandwich structure of the inlays 807, 808 in order to match bulk and inlay material.

The effect of using the compensation inlays 807, 808, which consist of sandwich structures of different materials and forms, is to avoid cracking caused by residual intrinsic stress from the manufacturing process (e.g. brazing or Plasma Vapor Deposition). The different materials may be ordered by their thermal expansion coefficient and/or their mutual adhesion. Those having characteristics close to the bulk bearing material may be located closest to the latter.

Figure 9:
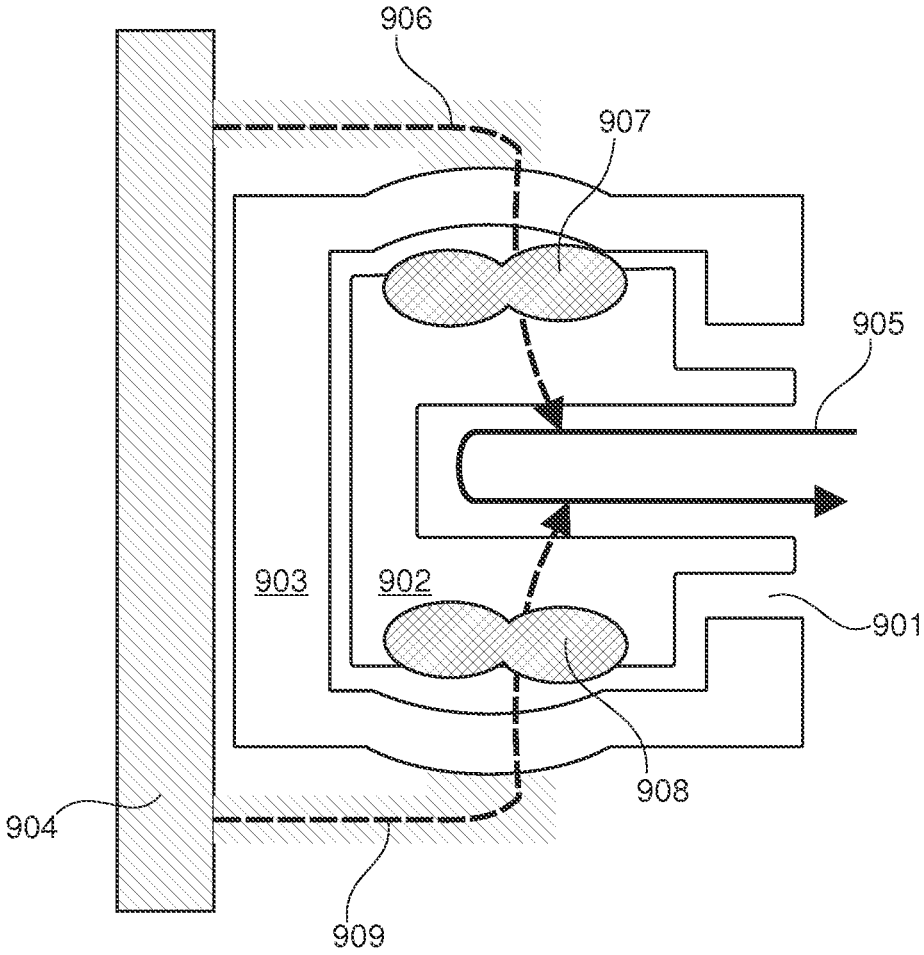

FIG. 9 depicts the heat flux 906, 909, which starts from the heat source, the anode 904, and leads to the heat sink, the circulating cooling fluid 905. The heat flux is passing through the rotary part 903 of the tube, the gap 901 to the stationary part 902 of the tube. According to this embodiment there are inlays 907, 908, which are formed for maximal bearing stability such that the shapes of the active bearing surfaces and gap 901 are optimally formed upon heating.

Therefore, the compensation inlays 907, 908 may be formed such that upon heating the bearing gap 901 is formed locally in a desired way. When hot, the gap 901 may get a minimal size in those areas where the bearing is loaded most. E.g. to handle gyroscopic forces, this is needed at the outer edges of the set of radial bearings.

Figure 10:
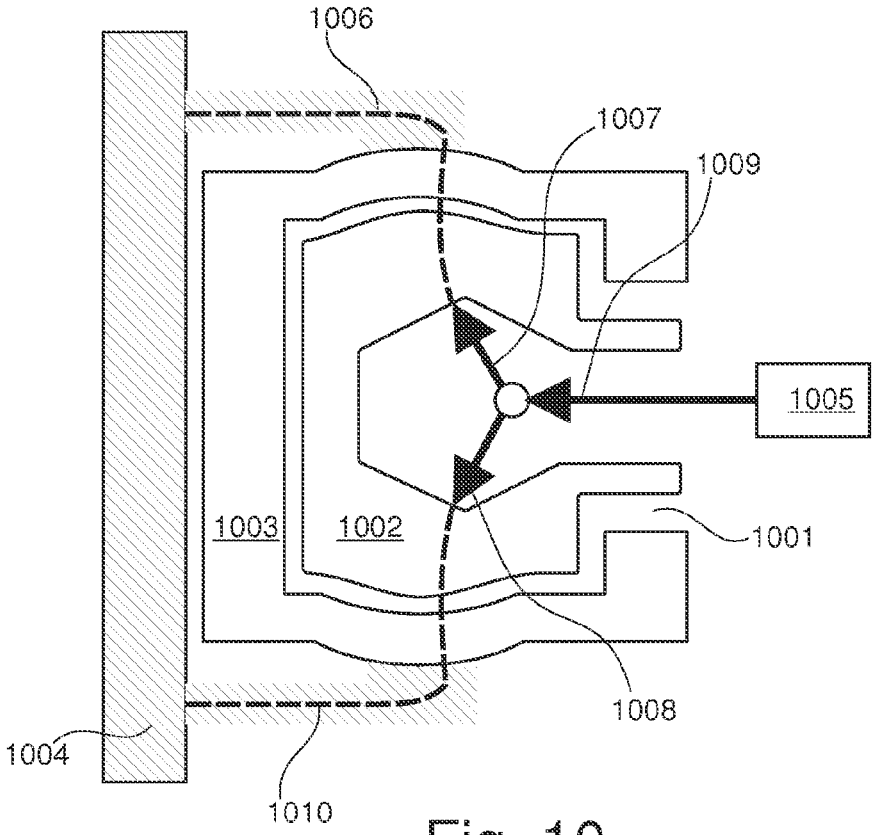

FIG. 10 depicts the arrangement of the tube with the anode 1004, the rotary part 1003 of the tube, the stationary part 1002 of the tube, the gap 1001 between the rotary part 1003 and the stationary part 1002. There is also shown the heat flux 1006, 1010. Within the stationary part 1002 of the tube there is arranged a piston-type mechanical expansion device, wherein there is expansion upon pressing. The levers 1007, 1008 are controlled by the thermal expansion device 1005 with the help of the piston 1009.

According to this embodiment of the invention the inner hollow axis 1002 may be expanded also mechanically. The actuated piston 1009 pushes levers 1007, 1008, which push out the inner surface of the hollow axis 1002. The force on the piston 1009 may be generated through a device 1005 which expands upon rising temperature. (material with large $c_{th}$). This may serve as an automatic expansion control. The piston 1009 may also be driven by hydrodynamic pressure of the cooling fluid, e.g. using an aperture. The aperture would be attached to the piston 1009. The amount of oil flow controls the pressure drop across the aperture and with it the force on the piston 1009. According to the invention mechanical and thermal compensation may also be combined.

Figure 11:
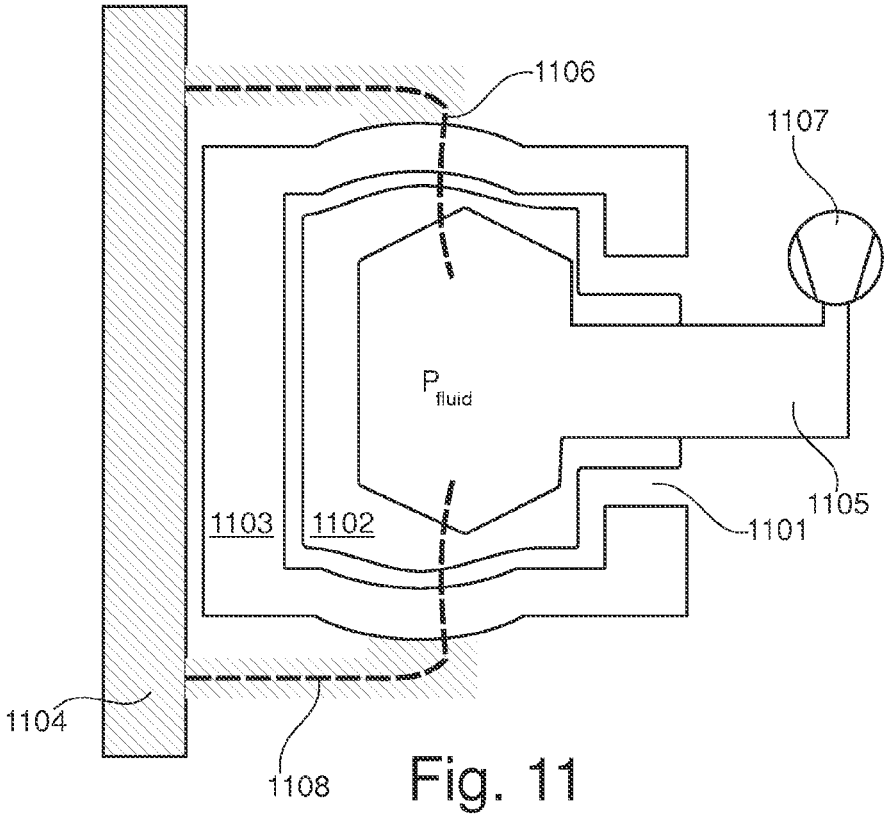

FIG. 11 depicts the arrangement of the tube with the hot anode 1104, the rotary part 1103 of the tube, the stationary part 1102 of the tube and the gap 1101. It is also shown the heat flux 1106, 1108. In order to stabilize the dimensions of the gap 1101 the hollow axis 1102 is filled with a fluid with the pressure $P_{fluid}$. This pressure $P_{fluid}$ is achieved by using a hydraulic pump 1107, which supplies the fluid through the channel 1105 to the hollow axis 1102.

A static fluid pressure $P_{fluid}$ can be applied to the bearing axis 1102. When the inner wall of the axis 1102 is thin enough (ca. 1 mm), this pressure $P_{fluid}$ can drive the expansion of the inner axis 1102. The local thickness of the wall is chosen such, that the local expansion optimally matches the thermal expansion of the outer rotating bearing member. Usually the inner surface of the bearing axis 1102 is cooled with a circulating fluid, driven by fluid pump 1107. The heat is then dissipated to the ambient by an external heat exchanger. The static pressure $P_{fluid}$ can also be applied in such a case. The whole fluid circuit is then put under this static pressure $P_{fluid}$ in addition to the dynamic pressure generated by the driving pump 1107. Usually the fluid will be fluent (water, oil), but the invention comprises also other forms of fluids (air under pressure).

Figure 12:
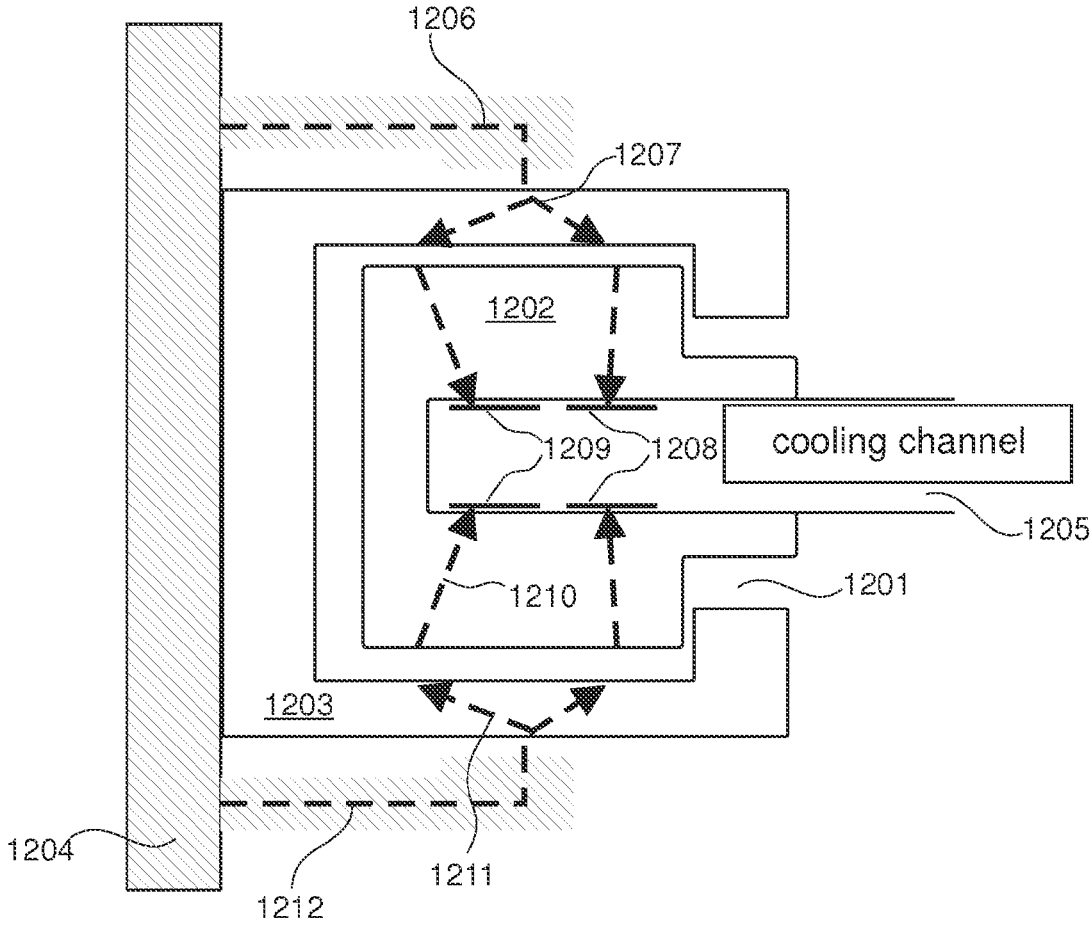

FIG. 12 depicts an embodiment of the invention, wherein the heat flux 1206, 1212 is directed from the anode 1204 to the rotary part 1203 of the tube, wherein the heat flux 1206, 1212 can be divided in e.g. two parts 1211, 1207, which get through the gap 1201 and arrive at the stationary part 1202 of the tube. This leads to the effect that the heat is no more focused on single spots. It is also shown radial bearings 1209, 1208 within the cooling channel.

This embodiment leads to the effect that the heat conduction will be channeled through the anode 1204 in such a way that there is only uniform bearing gap deformation. The pattern is achieved through shaping of the parts and/or selection of materials. Shaft cooling is done in such a way to prevent non-uniform gap deformation, i.e. the gap 1201 may be distorted, but symmetrically in the radial bearings 1209, 1208, such that both radial bearings 1209, 1208 still have the same stiffness.

It should be noted that the term 'comprising' does not exclude other elements or steps and the 'a' or 'an' does not exclude a plurality. Also elements described in association with the different embodiments may be combined.

It should be noted that the reference signs in the claims shall not be construed as limiting the scope of the claims.

LIST OF REFERENCE SIGNS

101 X-ray tube,
102 X-ray tube,
103 X-radiation,
201 bearing gap,
202 hollow bearing axis,
203 circulating cooling fluid,
204 rotating bearing sleeve,
205 rotating anode,
301 gap,
302 hollow bearing axis,
303 rotating bearing sleeve,
304 circulating cooling fluid,
305 rotating anode,
306 axial bearing
307 radial bearing,
401 gap,
402 rotary part,
403 stationary part,
404 anode,
405 circulating cooling fluid,
406 gravity,
501 gap,
502 rotary part,
503 stationary part,

504 anode,
505 circulating cooling fluid,
506 heat flux,
507 bearing gap,
508 heat flux,
509 site,
510 site,
511 site,
601 gap,
602 stationary part,
603 rotary part,
604 anode,
605 site,
606 heat flux,
607 bearing gap,
608 circulating cooling fluid,
609 bearing gap,
610 site,
611 site,
612 heat flux,
701 gap,
702 stationary part,
703 rotary part,
704 anode,
705 circulating cooling fluid,
706 heat flux,
707 inlay
708 inlay,
709 heat flux,
801 gap,
802 stationary part,
803 rotary part,
804 anode,
805 circulating cooling fluid,
806 heat flux,
807 inlay,
808 inlay,
809 heat flux,
901 gap,
902 stationary part,
903 rotary part,
904 anode,
905 circulating cooling fluid,
906 heat flux,
907 inlay,
908 inlay,
909 heat flux,
1001 gap,
1002 stationary part,
1003 rotary part,
1004 anode,
1005 thermal expansion device,
1006 heat flux,
1007 lever,
1008 lever,
1009 piston,
1010 heat flux,
1101 gap,
1102 stationary part,
1103 rotary part,
1104 anode,
1105 channel,
1106 heat flux,
1107 hydraulic pump,
1201 gap,
1202 stationary part,
1203 rotary part,
1204 anode,
1205 cooling channel,
1206 heat flux,
1207 heat flux,
1208 radial bearing,
1209 radial bearing,
1210 heat flux,
1211 heat flux,
1212 heat flux.

The invention claimed is:

1. An X-ray tube for generating X-radiation comprising:
a rotary structure comprising a rotating anode;
a stationary structure for rotatably supporting the rotary structure;
a bearing which is arranged between the rotary structure and the stationary structure, wherein the bearing comprises a gap between the rotary structure and the stationary structure; and
means for stabilizing dimensions of the gap with respect to distortions because of thermo-mechanical causes.

2. The X-ray tube according to claim 1, wherein the gap has a wall as a mechanical limitation, wherein the means for stabilizing comprise an inlay which is inserted in the wall, and wherein the inlay has a different thermal expansion coefficient with respect to at least a part of the wall.

3. The X-ra tube according to claim 2, wherein the inlay is arranged adjacent to the gap.

4. The X-ray tube according to claim 2, wherein the inlay has a large thermal expansion coefficient and is arranged in a relatively cold surrounding.

5. The X-ray tube according to claim 2, wherein the inlay has a small thermal expansion coefficient and is arranged in a relatively hot surrounding.

6. The X-ray tube according to claim 2, wherein the inlay comprises a sandwich structure of first and second different materials, wherein the first material has a close thermal expansion coefficient compared to the thermal expansion coefficient of the wall and is arranged adjacent to the wall, and wherein the second material has a thermal expansion coefficient which is substantially different compared to the thermal expansion coefficient of the wall and is arranged far away to the wall.

7. The X-ray tube according to claim 2, wherein the inlay is configured stabilize the dimensions of the gap because of an appropriate shape.

8. The X-ray tube according to claim 2, further comprising means for deforming the wall to stabilize the dimensions of the gap.

9. The X-ray tube according to claim 8, wherein the means for deforming comprise a lever for applying a mechanical force on the wall.

10. The X-ray tube according to claim 8, wherein the means for deforming comprise means for applying fluid pressure on the wall.

11. The X-ray tube according to claim 8, wherein the wall has a thickness of about 1 to 20 mm.

12. The X-ray tube according to claim 1, wherein the means for stabilizing comprise a channel for directing a flow of heat, and wherein the channel is configured to maintain uniform deformation of the gap.

13. The X-ray tube according to claim 1, wherein means for stabilizing is moveable to stabilize the dimensions of the gap are arranged.

14. The X-ray tube according to claim 1, wherein the X-ray tube is used for diagnostics and is configured to stabilize the dimensions of the gap.

15. The X-ray tube of claim 1, wherein the means for stabilizing the dimension of the gap provide a controlled radial matching expansion of the rotary structure and the stationary structure.

16. A method for manufacturing an X-ray tube for generating X-radiation, the method comprising acts of:

providing a rotary structure connected to a rotating anode and a stationary structure for rotatably supporting the rotary structure;

placing a bearing gap between the rotary structure and the stationary structure; and placing a stabilizer in the gap, the stabilizer stabilizing the dimensions of the gap with respect to distortions due to thermo-mechanical causes.

17. An X-ray tube for generating X-radiation, comprising:

a rotary structure connected to a rotating anode;

a stationary structure for rotatably supporting the rotary structure;

a bearing having a gap between the rotary structure and the stationary structure; and a stabilizer positioned in the gap for stabilizing dimensions of the gap with respect to distortions due to thermo-mechanical causes.

18. The X-ray tube of claim 17, wherein the gap has a wall for providing a mechanical limitation and the stabilizer comprises an inlay inserted in the wall, the inlay having a different thermal expansion coefficient with respect to at least a part of the wall.

19. The X-ray tube according to claim 18, further comprising a deformer configured to deform the wall to stabilize the dimensions of the gap, wherein the deformer comprises a pressurizer configured to apply fluid pressure on the wall.

20. The X-ray tube according to claim 17, wherein the stabilizer comprises a channel for directing a flow of heat, the channel is configured to maintain the deformation of the gap uniform.

* * * * *